US010998661B2

(12) United States Patent
Wright et al.

(10) Patent No.: US 10,998,661 B2
(45) Date of Patent: May 4, 2021

(54) ELECTRICAL CONNECTOR FOR CONNECTING ELECTRICAL CONDUCTORS TO A PRINTED CIRCUIT BOARD

(71) Applicant: Weidmüller Interface GmbH & Co. KG, Detmold (DE)

(72) Inventors: Stephan Wright, Detmold (DE); Marvin Krecht, Löhne (DE); Lars Brinkmann, Detmold (DE); Bernd Van Giesen, Detmold (DE)

(73) Assignee: Weidmüller Interface GmbH & Co. KG

( * ) Notice: Subject to any disclaimer, the term of this patent is extended or adjusted under 35 U.S.C. 154(b) by 0 days.

(21) Appl. No.: 16/658,458

(22) Filed: Oct. 21, 2019

(65) Prior Publication Data

US 2020/0127407 A1 Apr. 23, 2020

(30) Foreign Application Priority Data

Oct. 22, 2018 (DE) ..... 102018126144.6

(51) Int. Cl.
*H01R 13/24* (2006.01)
*H01R 13/15* (2006.01)

(52) U.S. Cl.
CPC ..... *H01R 13/2407* (2013.01); *H01R 13/15* (2013.01); *H01R 13/2457* (2013.01); *H01R 13/2471* (2013.01)

(58) Field of Classification Search
CPC ..... H01R 13/2407; H01R 13/15; H01R 13/2457; H01R 13/2471; H01R 4/4818; H01R 4/4809; H01R 4/2454
USPC ..... 439/620.22, 435, 441
See application file for complete search history.

(56) References Cited

U.S. PATENT DOCUMENTS 5,546,280 A * 8/1996 Hasebe ..... H01C 10/00 361/752
5,920,252 A * 7/1999 Nakagawa ..... H01C 10/32 338/160
6,039,582 A * 3/2000 Geis ..... H01R 4/4818 336/90
6,056,585 A * 5/2000 Hatakeyama ..... H01R 4/4818 439/441

(Continued)

*Primary Examiner* — Hien D Vu
(74) *Attorney, Agent, or Firm* — Laubscher & Laubscher, P.C.

(57) ABSTRACT

An electrical connector and a method for fastening the connector to a circuit board has a connecting chamber in which a conductor rail is arranged. The conductor rail is electrically connected at a connecting side of the electrical connector to an electrical connecting part make electrical contact at a contact side with a circuit board. The conductor rail includes a connecting arm for connection with the electrical connecting part and a contact arm for connection with the circuit board. The connecting arm and the contact arm are joined together by a connection arm. The connecting part is displaced in a connecting direction extending parallel to the conductor rail for connection with the conductor rail. The contact arm is designed as a spring in order to press against the circuit board when they are connected. The conductor rail can be positioned in two mutually rotated positions and the electrical connector may have at least two adjacent connecting chambers.

12 Claims, 15 Drawing Sheets

(56) References Cited

U.S. PATENT DOCUMENTS 6,128,181 A * 10/2000 Higami ..... H01R 4/4818
174/252
6,420,957 B1 * 7/2002 Harada ..... H01C 1/14
338/162
9,673,542 B1 * 6/2017 Decker ..... H01R 12/515

* cited by examiner

ELECTRICAL CONNECTOR FOR CONNECTING ELECTRICAL CONDUCTORS TO A PRINTED CIRCUIT BOARD

This application claims priority of DE 10 2018126144.6 filed Oct. 22, 2018. The entire content of this application is incorporated herein by reference.

BACKGROUND OF THE INVENTION

For the connection of electrical conductors or multi-core cables to electrical circuit boards, connection plugs are used. The plugs have either a contact pin for each conductor for inserting into a through opening of the circuit board or a contact surface for placing against a solder surface of the circuit board to which the conductor tracks of the circuit board can be soldered.

Connection plugs are also known which have plug contacts which can be inserted into through openings of the circuit board, the plug contacts being designed for clamping in the through openings. Such connection plugs can be connected and retrofitted quickly and easily to the circuit board. However, the plug contacts are costly to manufacture.

Basically, in the case of such connection plugs the danger exists that the connection plugs will be positioned at a slant to the circuit board which is detrimental. This is particularly likely under tensile loading on the electrical conductor or cable, especially in a direction at an angle to the circuit board.

Therefore, the problem which the present invention seeks to solve is to improve an electrical connector for connecting an electrical conductor to an electrical circuit board such that it is quicker and easier to connect or retrofit it to the circuit board, and it is easy and economical to produce. The electrical connector provides favorably dimensioned venting and creepage between the individual contacts of the connector and secure contact of the connector with the circuit board, even under tensile loading.

SUMMARY OF THE INVENTION

Accordingly, it is a primary object of the invention to provide an electrical connector for connecting an electrical conductor to a circuit board. The electrical connector has a connecting chamber in which a conductor rail is arranged, wherein the conductor rail can be electrically connected at a connecting side of the electrical connector to an electrical connecting part. The electrical connector has a contact side which makes electrical contact with a circuit board. The conductor rail includes a connecting arm for the connecting of the electrical connecting part, and a contact arm for the connecting to the circuit board, wherein the connecting arm and the contact arm are joined together by a connection arm, and wherein the connecting arm extends in a connecting direction.

A further object is to provide a method for fastening such an electrical connector to a circuit board.

An electrical connector is created. The connector is designed for the electrical connection of an electrical connecting part, such as an electrical conductor or plug, to a circuit board.

The connector includes a conductor rail which is arranged in a connecting chamber of the connector. The conductor rail can be electrically connected at a connecting side of the electrical connector to an electrical connecting part. It can make electrical contact at a contact side of the electrical connector with a circuit board. It therefore extends inside the connecting chamber from the connecting side to the contact side. This configuration enables the direct connection of the connecting part and the circuit board to the conductor rail.

The conductor rail includes a connecting arm, extending in a connecting direction for connection with the electrical connecting part. Furthermore, it has a contact arm for connection with the circuit board. The connecting arm and the contact arm are joined together by a connection arm.

The conductor rail is preferably formed as a single piece. It is made as a stamped and bent part, especially from a good conducting material such as copper or a copper alloy. This is possible in a very cost effective manner with conventional methods. The conductor rail may also be a compound part. However, the single piece embodiment is preferred.

The contact arm is designed as a spring in order to press against the circuit board to form a connection. Owing to the spring configuration of the contact arm, it is pressed against a restoring force against the circuit board. In this way, the contact arm makes electrical contact with contact surfaces such as solder pads on the circuit board.

It is preferable for the connecting direction in the connecting condition of the connector to the circuit board to extend perpendicular to the circuit board. In this embodiment, the connector can be placed on the circuit board in a perpendicular manner.

In order to assure a flat connection of the contact arm against the contact surface, the contact arm extends at an acute angle or substantially parallel to the circuit board. A contact lug may be provided at an open end of the contact arm. The contact lug preferably has a bow shape and is designed to contact the circuit board.

In order to configure the contact arm as a spring, the connection arm extends transversely to the connecting arm and has a bow. The connection arm and the contact arm together define a U shape. Thus, when the contact arm is placed on the circuit board, it can be pressed against the restoring force in the direction of the connecting arm. In this way, its free end in a connecting condition in which the connector is arranged on the circuit board is pressed with the restoring force against it. Furthermore, in order to avoid tilting of the connector and in order to form an abutment, the connector is fastened to or on the circuit board.

Furthermore, the conductor rail on the connecting side of the connector can be designed as a clamping contact or as a section of a clamping contact, as a soldered contact, as a crimp contact, as a cutting contact or as a plug contact. A clamping surface, a soldered web, a crimp connection, a socket or a plug may be provided at one free end of the connecting arm.

In a preferred embodiment, the conductor rail can be positioned in two positions in the connecting chamber, wherein it is rotated in the first position by 180° in a direction of rotation about the connecting direction relative to the second position. In this way, the contact arm can extend in or against a transverse direction of the connector. A tilting moment acting on the connector by the restoring force therefore acts in opposite directions in both positions.

Preferably the connecting side and the contact side of the connecting chamber are situated on opposite sides of the connector. Electrical connecting parts can therefore be mounted from above and connected to the connector in the connecting condition with the connector mounted on the circuit board. In this way, tensile stress on the connecting part can for the most part be avoided.

The connector preferably includes an inner wall, against which the connecting arm of the conductor rail lies in at least a partially flat condition. The inner wall and/or the conductor rail extend perpendicular to the circuit board. In this way, the connecting direction also extends perpendicular to the circuit board. The conductor rail preferably includes a holding device which is arranged on the connecting arm and which engages a recess of the inner wall. Owing to the holding device, the conductor rail can be positioned on the inner wall in a defined manner. Preferably, the holding device is wave shaped and serves as an end stop for a clamping leg of a clamping spring.

In another embodiment, the electrical connector includes two or more connecting chambers in which a respective conductor rail is arranged, the connecting chambers being positioned alongside each other such that their connecting sides form a common connecting face and their contact sides form a common contact face of the connector. By arranging a further connecting chamber against the at least two connecting chambers, the connector can be adapted to the circuit board in order to connect any given number of electrical connecting parts.

The conductor rails in the connecting chambers are preferably arranged partly in a first and partly in a second position. It is preferred to arrange the same number of conductor rails of the connector in the first position and in the second position, and/or for the arrangement of the conductor rails to follow a uniform pattern. In this way, twisting and tilting moments on the connector can be avoided, such as are caused by the restoring force of the contact arms of the conductor rails. Furthermore, venting and creepage are optimized. The conductor rails of adjacent connecting chambers are therefore preferably arranged alternately in the first position and the second position. Then the twisting and tilting moments will be canceled out if the same number of conductor rails is arranged in the first position as in the second position.

Furthermore, the connecting chambers are arranged respectively in housing parts of the connector which are situated in a top housing. The housing parts are preferably latched in the top housing. On the one hand, the housing parts can be mounted very quickly and easily in the top housing. Furthermore, the top housing provides a secure antishock protection for the user.

According to a further embodiment, the conductor rail or the conductor rails on the contact side of the connector are designed as a plug or solder contact. In this embodiment, the conductor rail can be produced very economically as a stamped and bent part and the connector as a whole can therefore be produced easily and economically. Furthermore, the connector can likewise be connected quickly to the circuit board.

According to a method for fastening an electrical connector to a circuit board, the connector is placed and pressed on the circuit board in a connecting direction perpendicular to the circuit board with the mating contacts of the circuit board being contacted by the contacts of the connector. Next, the housing or top housing of the connector is secured to the circuit board.

Such a connector can be connected or retrofitted quickly to an electrical circuit board. If the connector includes multiple connecting chambers, tilting moments caused by the restoring force of the contact arms and acting when the connector is pressed against the circuit board can be canceled by arranging the conductor rails alternately or at least in a pattern in the first and the second positions. Owing to latching of the connector on the circuit board, the connector is furthermore securely positioned on the circuit board. This assures the contact of the compression spring contacts of the connector with contact surfaces on the surface of the circuit board in a durable manner and with good venting and creepage.

The housing or top housing of the connector is then secured with latches or screws or other locking devices in the area of openings of the circuit board and anchored there.

BRIEF DESCRIPTION OF THE FIGURES

Other objects and advantages of the invention will be described with reference to the accompanying drawings, in which.

DETAILED DESCRIPTION

Figure 1A:
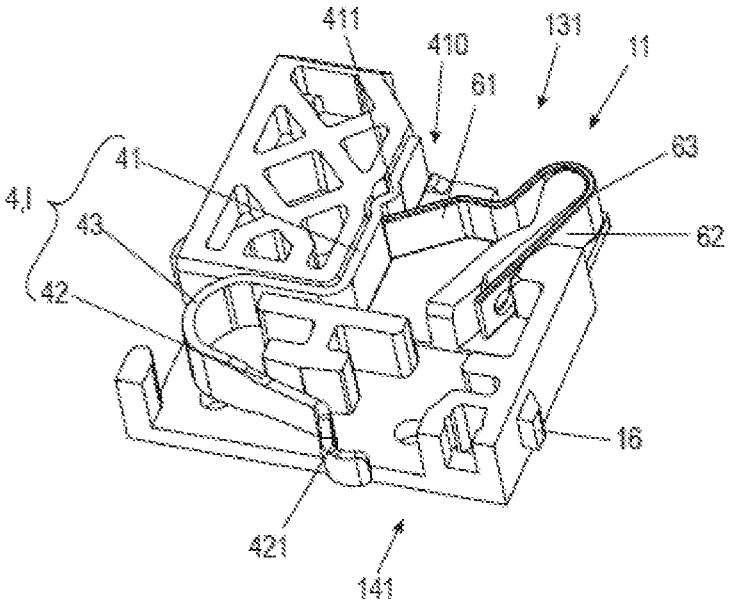
FIGS. 1*a*-1*c* are perspective views, respectively, of a housing component of an electrical connector according to the invention.
Figure 1B:
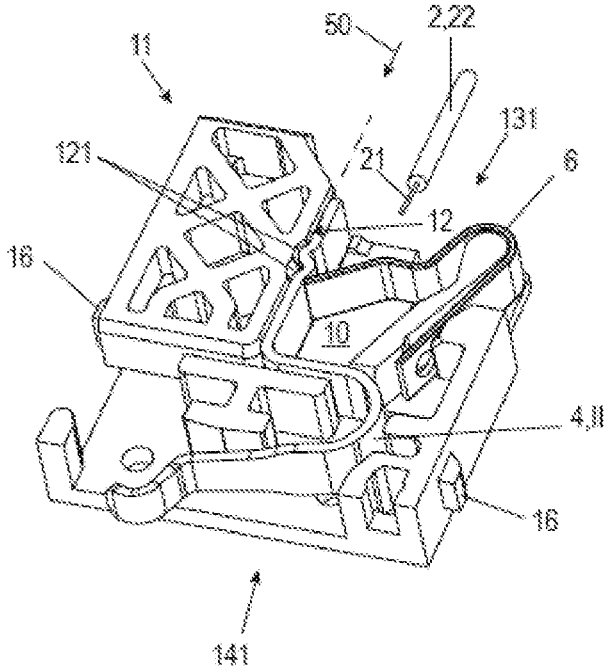
Figure 1C:
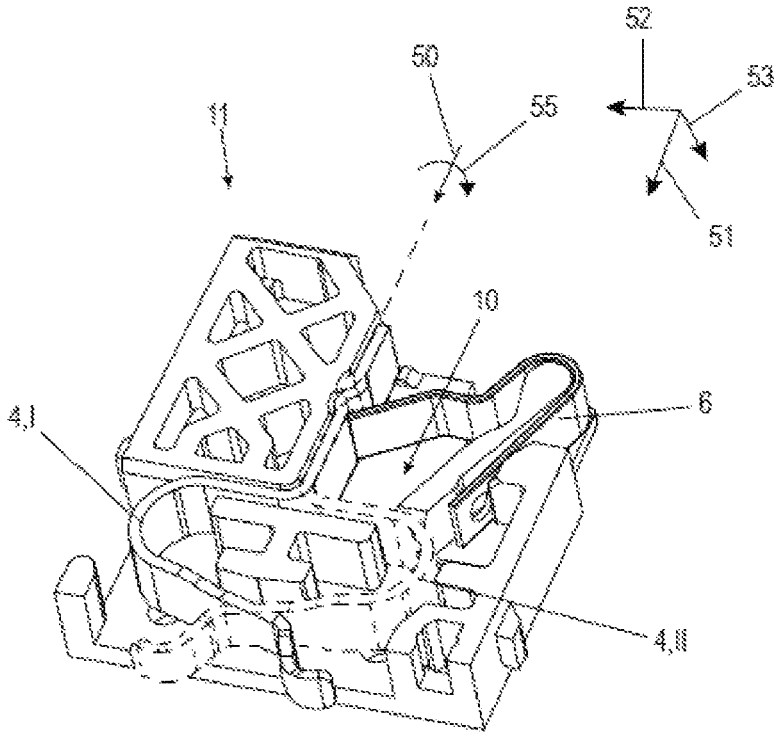

FIGS. 1*a-c* show a housing 11 of an electrical connector 1 according to the invention. In the housing 11 there is provided a connecting chamber 10. The connecting chamber 10 is designed to receive a conductor rail 4. The conductor rail here is made as a single piece of stamped and bent conducting material. It extends through the connecting chamber 10 from a connecting side 131 of the housing 11 to a contact side 141 of the housing 11. The connecting side 131 and the contact side 141 are situated opposite each other. But the invention also applies to connectors 1 in which the connecting side 131 and the contact side 141 are situated at an angle (not shown) relative to each other, especially at a right angle to each other and/or adjacent to each other.

At the connecting side 131, an electrical connecting part 2 can be electrically connected directly to the conductor rail 4. At a contact side 141, the conductor rail 4 can make electrical contact with a circuit board 3.

The conductor rail 4 includes a connecting arm 41 for connection of the electrical connecting part 2 as well as a contact arm 42 for connection with the circuit board. The connecting arm 41 and contact arm 42 are joined together by a connection arm 43.

The connecting arm 41 extends in a connecting direction 50. It lies at least partially flat against an inner wall 12 of the housing part 11. On the connecting arm 41 of the conductor rail 4 there is provided a holding device 411 which engages with a recess 121 of the inner wall 12. Owing to the holding device 411, the conductor rail 4 is positioned on the inner wall 12 in a defined manner. The holding device 411 has a wavy configuration. In this way, the holding device 411 can serve at the same time as an end stop for a clamping leg 61 of a clamping spring 6. Preferably, instead of a wavy, rounded shape of the holding device 411, a somewhat angular or zig zag shape of the holding device 411 can also be provided. The recess 121 is formed corresponding to the holding device 411 so that the holding device 411 fits into the recess 121.

At the connecting side 131, the connecting arm 41 arm is formed as a clamping contact 410 such as a spring contact or a push in contact. A clamping spring 6 is provided which is secured by a holding leg 62 in the connecting chamber 10. The clamping spring 6 includes a clamping leg 61, which is designed for clamping the connecting part 2 in the connecting chamber 10. The clamping leg 61 and the holding leg 62 are joined together by a connection bow 63. The clamping spring 6 is made as a single piece of spring steel. When inserting the connecting part 2, the clamping leg 61 is pivoted into the connecting chamber 10 against a restoring force until the connecting part 2 can slide between the conductor rail 4 and the clamping leg 61. The clamping leg 61 is then pivoted back with the restoring force and clamps the connecting part 2 against the conductor rail 4.

FIG. 1*b* shows as an example an electrical conductor as a connecting part 2. But instead of an electrical conductor as the connecting part 2, a plug or an electrically conductive rod is provided. The electrical conductor 2 includes an electrically conductive core 21 and an electrically insulating casing 22. The insulation is stripped off at one end so that the casing 22 is removed and the core 21 is exposed. The electrical conductor 2 is connected with the clamping contact 410 of the connector 1 by introducing the stripped-off end of the conductor 2 in the connecting direction 50 between the conductor rail 4 and the clamping leg 61 is shown. The connecting direction 50 here extends in a first direction of extension 51 of the connector 1.

The contact arm 42 is formed as a spring. In a connecting condition (not shown) of the connector 1 to the circuit board 3, in which the connector 1 is placed on the circuit board 3, pressed against it, and latched to it, the contact arm 42 is designed to press against the circuit board 3. The connecting direction 50 therefore extends perpendicularly in the connecting condition of the connector 1 to the circuit board 3.

In order to provide the contact arm 42 with a spring action, the connection arm 43 extends transversely to the connecting arm 41. Furthermore, the connection arm 43 has a bow. In this way, the connection arm 43 and the contact arm 42 are arranged in a U shape.

Therefore, when the contact arm 42 is placed on the circuit board 3, it can be pressed against the restoring force toward the connecting arm 41, so that its free end (not shown) in the connecting condition is pressed with the restoring force against the circuit board 3. Next, the connector 1 is fastened with a latch, snap, screw and/or clamping device (not shown), for example a clasp, a tongue, or a latching arm, to the circuit board 3 so that the connector 1 can no longer be released spontaneously from its position (not shown).

The spring force of the contact arm is configured to provide very good contact. The contact arm 42 has at its open end a contact lug 421, shaped as a bow and designed for contact with the circuit board 3. Owing to the bow shape, the contact surface 31 of the circuit board 3 is not damaged when the contact lug 421 is pressed against it.

The U-shaped arrangement of the contact and connection arms 42, 43 results in a tilting moment on the connector 1 while tilting of the connector 1 is at first prevented by the latching of the connector 1 on the circuit board 3.

In order to further equalize the tilting moment as much as possible and prevent tilting of the connector 1 from the outset, the conductor rail 4 can be positioned in two positions I, II in the connecting chamber 10 of the housing part 11. FIG. 1*a* shows the connector 1 with the conductor rail 4 arranged in the first position I, FIG. 1*b* shows the connector 1 with the conductor rail 4 arranged in the second position II, and FIG. 1*c* shows the conductor rail 4 in the first position I by solid lines and in the second position II in the connecting chamber 10 of the connector 1 by broken lines.

It can be seen that the conductor rail 4 in the first position I has been rotated by 180° relative to the second position II in a direction of rotation 55 about the connecting direction 50. In this way, the contact arm 42 in the first position I extends against a second direction of extension 52 of the connector 1, which extends transversely to the first direction of extension 51 of the connector 1, and therefore also transversely to the connecting direction 50. In the second position II, the contact arm 42 extends in the second direction of extension 52 of the connector 1. Therefore, in these two positions I, II, the tilting moment produced by the restoring force of the contact arm 42 when the connector 1 is pressed against the circuit board 3 acts in opposite directions.

By an adjacent positioning of two or more such housing parts 11 in a third direction of extension 53, which is situated transversely to the first direction of extension 51 and transversely to the second direction of extension 52, with conductor rails 4 which are arranged alternating in the first position I and in the second position II, a connector 1 can be produced for the connection of two or more connecting parts 2 to the circuit board 3 in which the tilting moments cancel out. Such a connector 1 will have no tendency to tilt at all with an even number of housing parts 11.

Figure 2A:
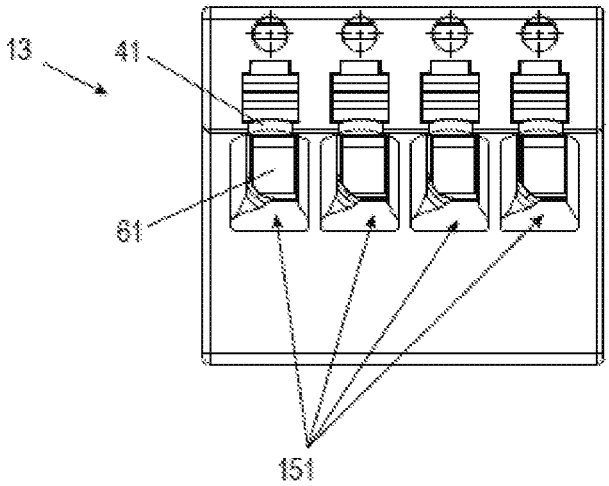
FIG. 2*a* is a plan view of a connecting side of the electrical connector according to the invention.
Figure 2B:
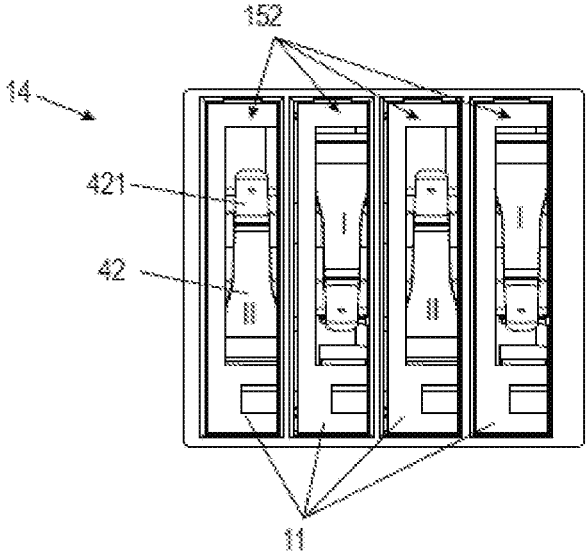
FIG. 2*b* is a plan view of a contact side of the electrical connector.
Figure 2C:
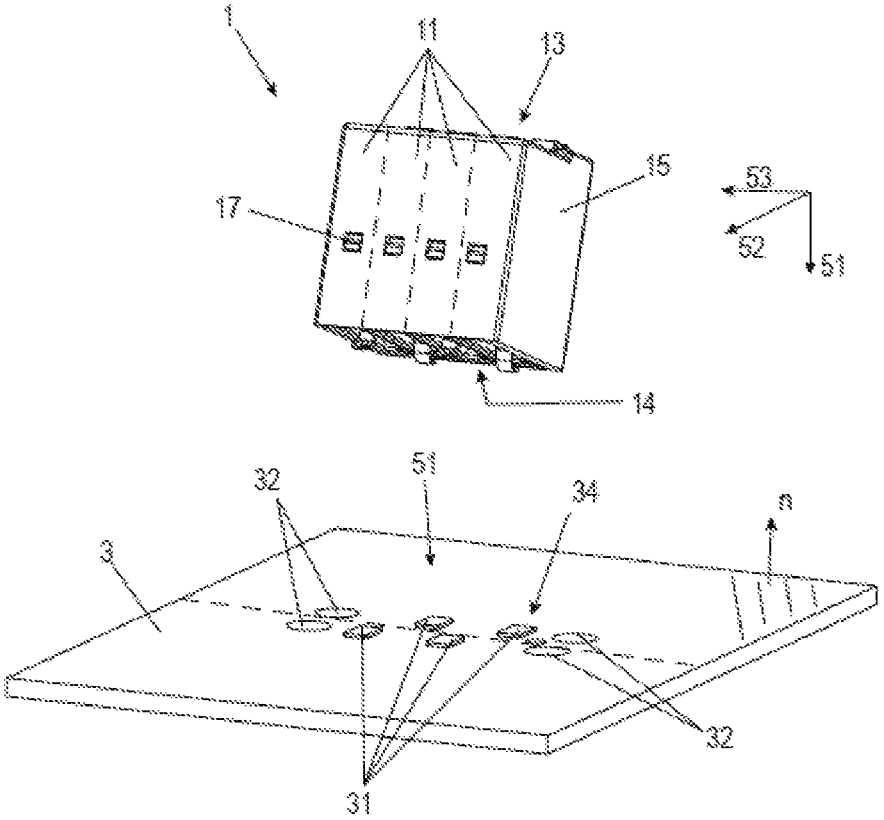
FIG. 2*c* is an exploded perspective view of the electrical connector and a circuit board with which the electrical connector is to be connected.

FIG. 2*a* shows a connecting face 13 of such an electrical connector 1, FIG. 2*b* shows a contact face 14 of the connector 1, and FIG. 2*c* shows the mounting of the connector 1 on a circuit board 3.

The connector 1 includes two or more connecting chambers 10 in which a conductor rail 4 is arranged. The connecting chambers 10 are positioned alongside each other in the third direction of extension 53. In this way, the connecting sides 131 and the contact sides 141 of the housing 11 are arranged flush with each other. The connecting sides 131 therefore together form a connecting surface 13 of the connector 1. The contact sides 141 together form a contact surface 14 of the connector 1.

In order to fasten the housings 11 next to each other, they are arranged in a top housing 15. Latching teeth 16 shown in FIGS. 1*a* and 1*b* are arranged on the housings which when inserted engage with latching openings 17 of the top housing 15. In this way, the housings 11 are no longer released spontaneously from the top housing 15.

At the connecting side, the clamping contacts 410 for the connecting parts 2 are accessible from the outside through connecting openings 151 in the top housing 15. At the contact side, sufficiently large contact openings 152 are provided on the one hand in order to shove the housing parts 11 into the top housing 15 and on the other hand in order to lead the contact arm 42 out from the top housing 15.

It can be seen in FIG. 2*b* that the conductor rails 4 of the housing parts 11 are alternately arranged in the first position I and in the second position II so that tilting moments produced by the restoring force when the connector 1 is pressed against the circuit board 3 cancel each other out, and therefore the connector 1 has no tendency to tilt.

The connector 1 is fastened to the circuit board 3 by setting it down perpendicularly. It is then pressed against the circuit board 3 so that the contact arm 42 or the contact lug 421 is pressed against a contact surface 31, especially against the surface of the circuit board 3, and makes electrical contact with it.

The contact surfaces 31 of the circuit board 3 form a conductor surface 34 which corresponds with the contact surface 14 of the connector 1. In this way, each contact arm 42 is associated with a contact surface 31, which makes electrical contact with it when the connector 1 is pressed against the circuit board 3.

The top housing is then preferably secured with latches or screws or some other locking devices in the area of openings of the circuit board (not shown).

Loosening or lifting the connector 1 from the circuit board 3 is prevented by latching the connector 1 to the circuit board 3, via a latch, snap, screw and/or clamping device (not shown) on the circuit board 3 and/or on the connector 1. Through boreholes 32 are provided for fastening such latch, snap, screw and/or clamping device on the circuit board 3.

FIGS. 3*a-c* and 4*a-c* show different embodiments of a conductor rail 4 for the electrical connector 1. The conductor rails 4 of FIG. 3 each have a wavy-shaped holding device 411 whose waves are arc-shaped and therefore rounded.

The holding device 411 of the conductor rails 4 of FIG. 4 is likewise wavy shaped. However, the waves of the holding device 411 are angular. On the whole, the holding device 411 is therefore formed as a zig zag shape.

Figure 3A:
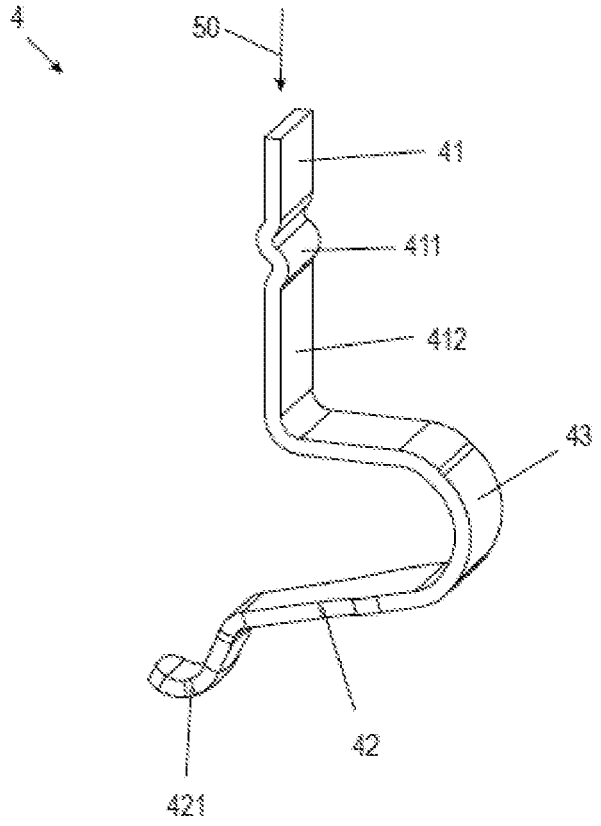
FIGS. 3*a-c*, 4*a-c*, 5*a*, 5*b*, and 6*a-c* are perspective views of different embodiments of electrical conductor rails for the electrical connector according to the invention.
Figure 4A:
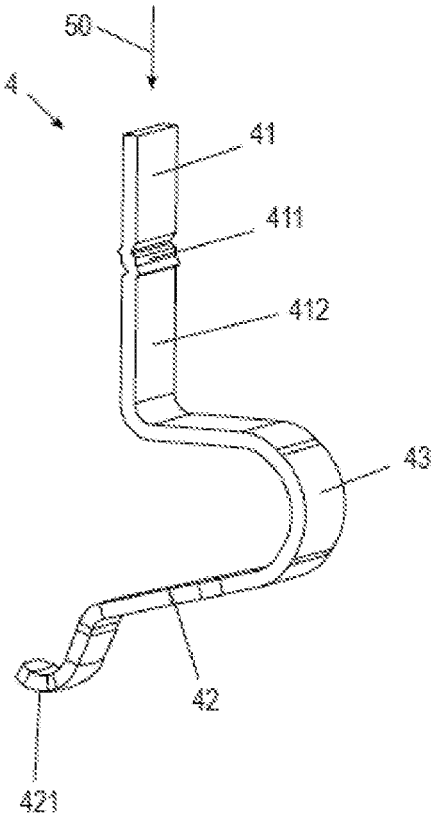

A bearing surface 412 provided underneath the holding device 411 against which the connecting part 2 bears in a condition inserted in the clamping contact 410 (not shown) in which it is clamped between the conductor rail 4 and the clamping leg 61 of the clamping spring 6 has a smooth configuration in each of FIGS. 3*a* and 4*a*.

Figure 3B:
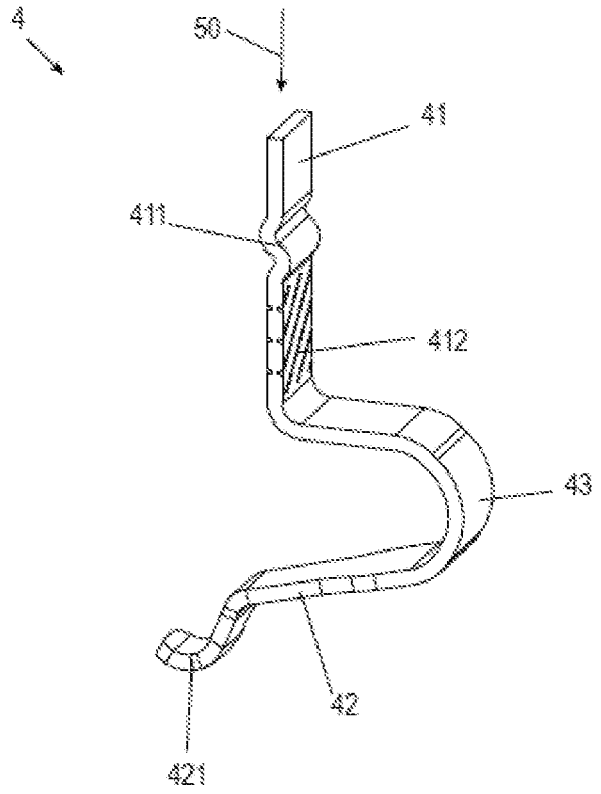
Figure 3C:
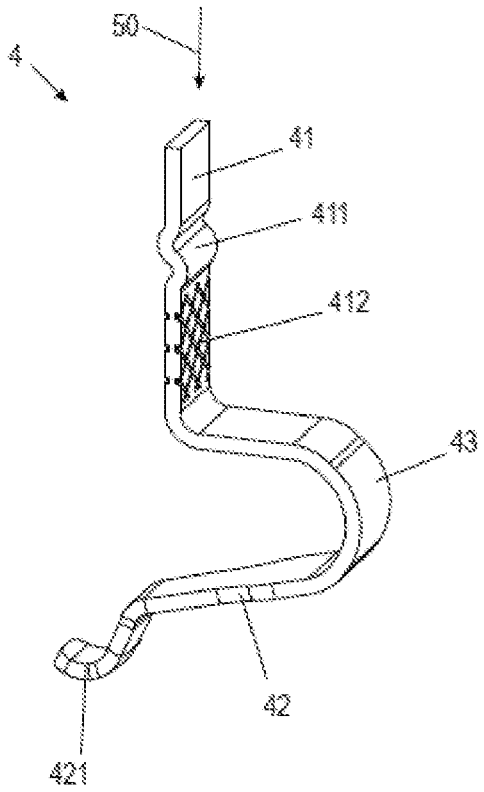
Figure 4B:
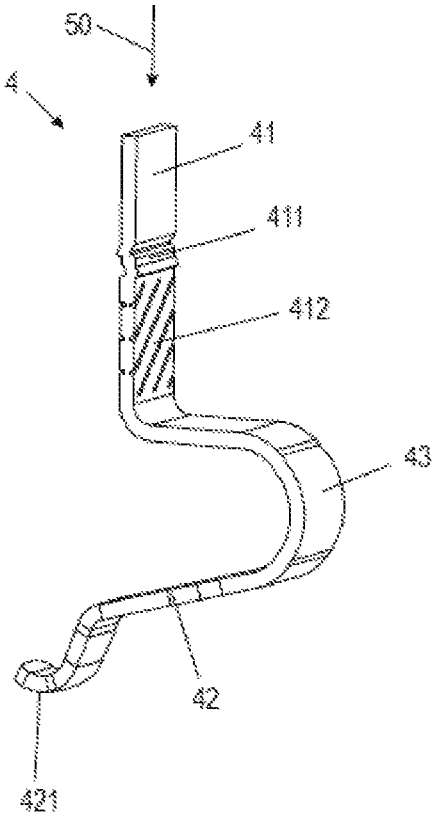
Figure 4C:
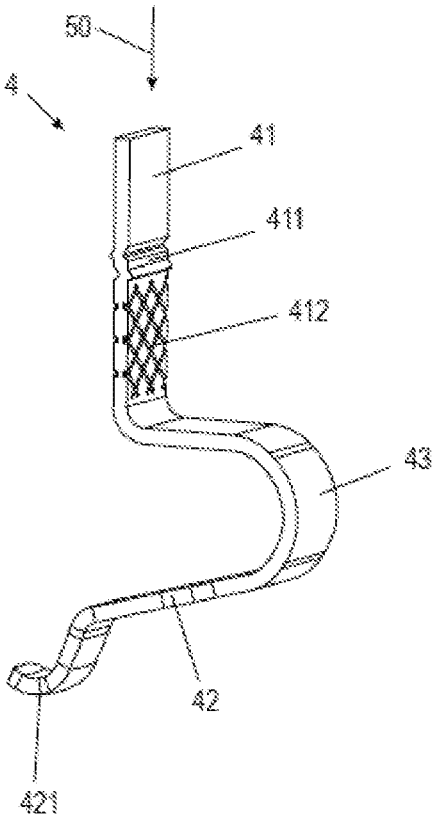

In FIGS. 3*b* and 4*b*, however, the bearing surface 412 includes a first rough surface and in FIGS. 3*c* and 4*c* a second rough surface different from the first rough surface. In FIGS. 3*b*, 3*c*4*b*, and 4*c* the bearing surface 412 acts as a frictional surface so that it improves the electrical contact between the conductor rail 4 and the connecting part 2.

Figure 5A:
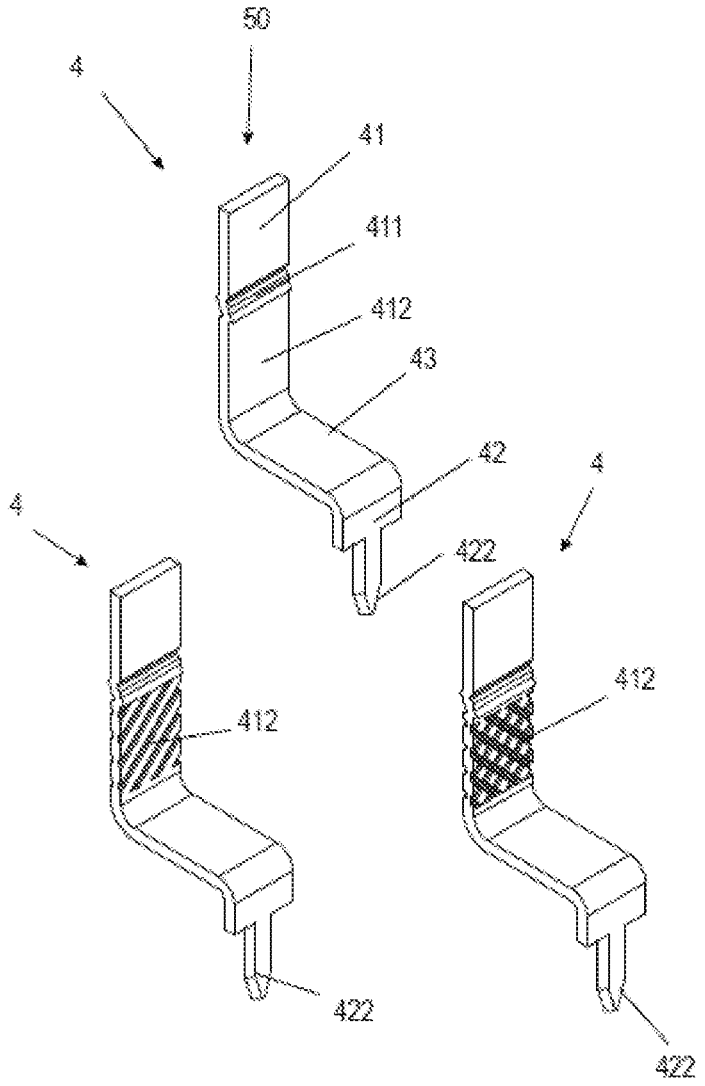
Figure 5B:
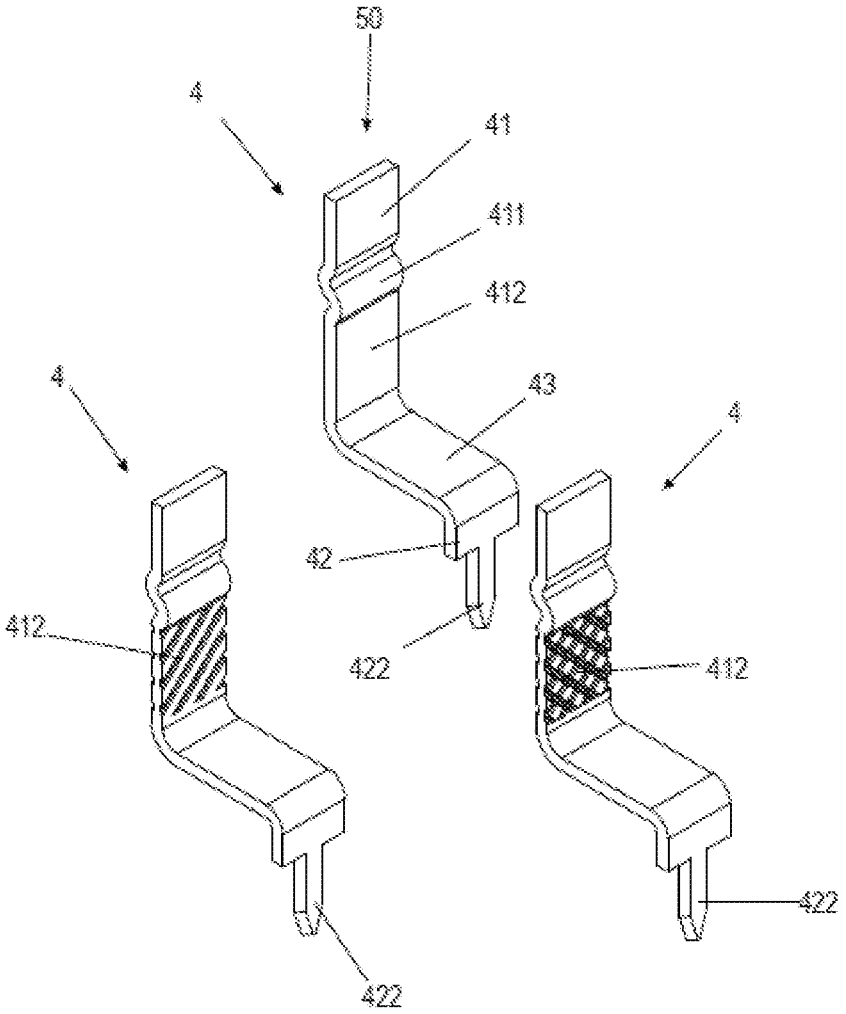

The conductor rails 4 represented in FIGS. 5*a* and 5*b* differ from the conductor rails 4 of FIGS. 3 and 4 by the contact arm 42. In FIGS. 5*a* and *d*5*b*, the conductor rail is formed as a plug and/or a solder contact. At the open end of the contact arm 42 there is provided a contact pin 422 instead of the contact lug 421. The contact arm 42 is situated at a right angle to the connection arm 43. The contact arms 42 of the depicted conductor rails 4 are therefore not resilient and not designed for pressing against the circuit board 3. Instead, the contact pins 422 of these conductor rails 4 are introduced perpendicularly into through boreholes of the circuit board 3 when the connector 1 is put in place and can then be soldered.

Figure 6A:
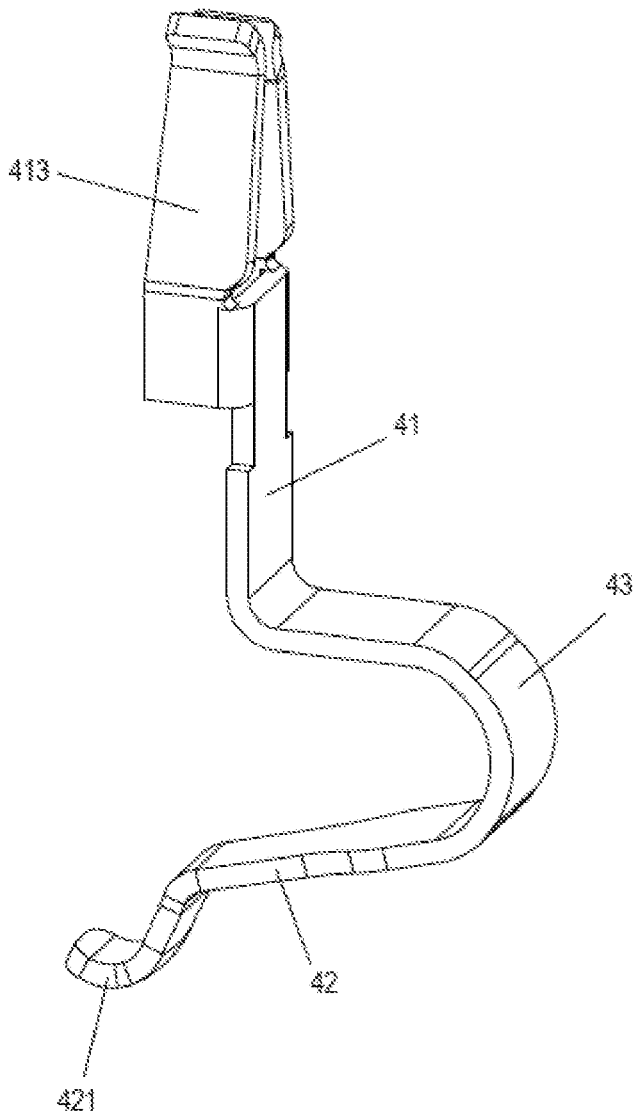
Figure 6B:
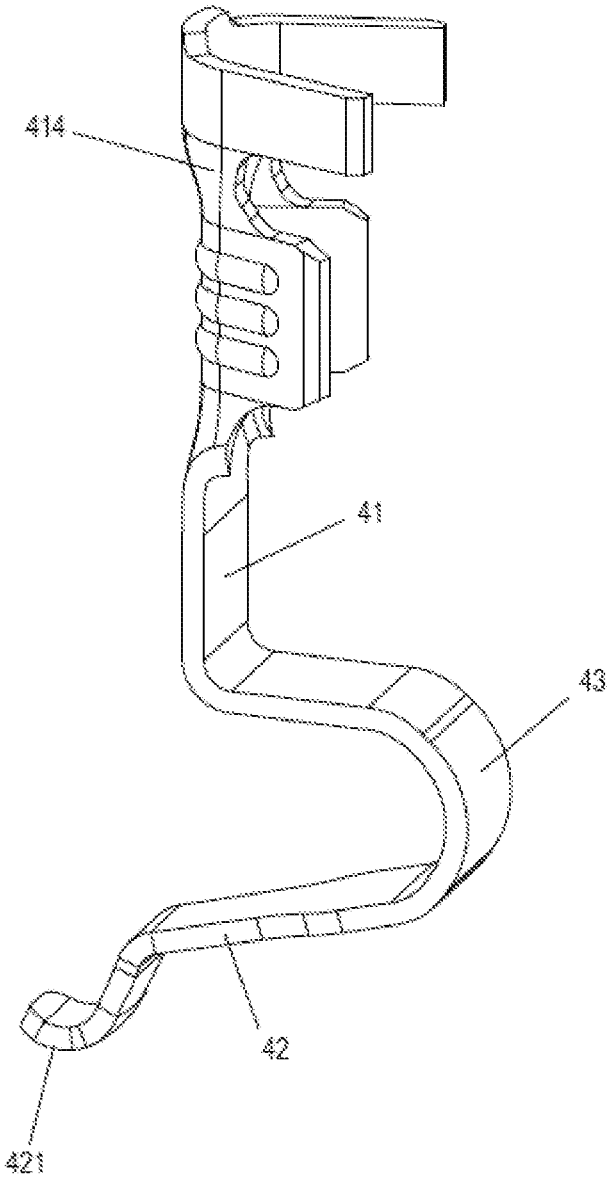
Figure 6C:
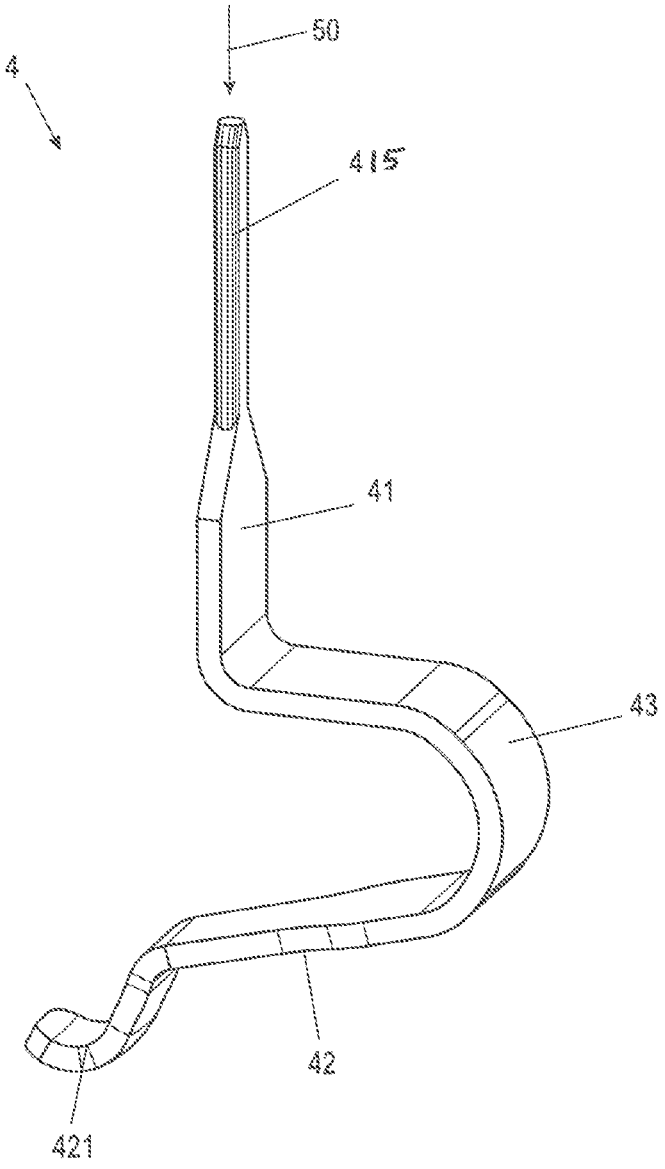

For the conductor rails 4 of FIG. 6, contact arms 42 similar to those of FIGS. 1-4 are resilient and provided for pressing against the circuit board 3. They differ in their configuration of the conductor rail 4 at the connecting side. They are not designed as a clamping contact 410. Instead, FIG. 6*a* shows a conductor rail 4 with a connecting socket 413 for connecting the connecting part 2, FIG. 6*b* shows one with a crimp connection or a crimp connector 414 for connecting the connecting part 2, and FIG. 6*c* shows one with a connecting plug 415 for connecting the connecting part 2.

The invention claimed is:

1. An electrical connector for connecting an electrical conductor with a circuit board, comprising:
   (a) a housing containing a connecting chamber and including an inner wall containing a recess;
   (b) a conductor rail arranged in said housing connecting chamber, said conductor rail including a connecting arm in electrical contact with an electrical conductor at a connecting side of said housing, a contact arm in electrical contact with a circuit board at a contact side of said housing, and a connection arm joining said connecting arm and said contact arm, said contact arm comprising a spring to press said housing against the circuit board, wherein said connecting arm lies against said housing inner wall in a partially flat condition and includes a projection which engages said inner wall recess, said conductor rail being displaceable between first and second positions within said connecting chamber.

2. The electrical connector as defined in claim 1, wherein said connecting side and said contact side of said housing are situated on opposite sides of said housing.

3. The electrical connector as defined in claim 1, wherein a connecting direction of said connecting arm extends perpendicular to the circuit board.

4. The electrical connector as defined in claim 1, wherein said conductor rail on the connecting side of said housing is designed as one of a clamping contact, a section of a clamping contact, a soldered contact, a crimp contact, a cutting contact, and a plug contact.

5. The electrical connector as defined in claim 4, wherein said clamping contact comprises a clamping spring contact.

6. The electrical connector as defined in claim 1, wherein said housing contains at least two connecting chambers in which a respective conductor rail is arranged, said connecting chambers being positioned adjacent each other with connecting sides of each chamber forming a common connecting surface and with contact sides of each chamber forming a common contact surface of said housing.

7. The electrical connector as defined in claim 6, wherein said conductor rails of adjacent connecting chambers are alternately arranged in the first and second positions, respectively.

8. The electrical connector as defined in claim 6, wherein said connecting chambers are provided in separate housings, respectively, said separate housings being arranged in a top housing.

9. The electrical connector as defined in claim 8, wherein said separate housings are latched in said top housing.

10. An electrical connector for connecting an electrical conductor with a circuit board, comprising
   (a) a housing containing a connecting chamber;
   (b) a conductor rail arranged in said connecting chamber, said conductor rail including a connecting arm extending in a connecting direction in electrical contact with a conductor at a connecting side of said housing, a contact arm in electrical contact with a circuit board at a contact side of said housing, and a connection arm joining said connecting arm and said contact arm, said contact arm comprising a spring to press said housing against the circuit board and said conductor rail being displaceable between first and second positions within said connecting chamber, said conductor rail being rotated in the first position by 180° in a direction of rotation about the connecting direction relative to the second position.

11. A method for fastening an electrical connector as defined in claim 1 to a circuit board, comprising the steps of
   (a) placing and pressing said housing on the circuit board in the connecting direction perpendicular to the circuit board with mating contacts of the circuit board being contacted by contacts of said conductor rail; and
   (b) securing said housing to the circuit board.

12. The electrical connector as defined in claim 10, wherein said conductor rail on said contact side of said housing comprises one of a plug and a solder contact.

* * * * *